US005474002A

United States Patent [19]

Goto et al.

[11] Patent Number: 5,474,002

[45] Date of Patent: Dec. 12, 1995

[54] EMBROIDERING MACHINE

[75] Inventors: Hisaharu Goto, Nagoya; Seiichiro Hagino, Chiryu, both of Japan

[73] Assignee: Aisin Seiki Kabushiki Kaisha, Kariya, Japan

[21] Appl. No.: 281,184

[22] Filed: Jul. 27, 1994

[30] Foreign Application Priority Data

Jul. 30, 1993 [JP] Japan ..... 5-190448

[51] Int. Cl.[6] ..... D05B 21/00

[52] U.S. Cl. ..... 112/102.5; 112/103; 112/470.04; 112/470.06

[58] Field of Search ..... 112/121.12, 121.11, 112/103, 277, 445, 78, 456

[56] References Cited

U.S. PATENT DOCUMENTS 4,693,197 9/1987 Tami ..... 112/121.11 X
4,960,061 10/1990 Tajima et al. ..... 112/103
5,050,513 9/1991 Frankel ..... 112/121.11
5,174,480 12/1992 Otokuni ..... 112/121.12 X
5,211,120 5/1993 Deoliveira ..... 112/121.11
5,323,722 6/1994 Goto et al. .

*Primary Examiner*—Peter Nerbun
*Attorney, Agent, or Firm*—Sughrue, Mion, Zinn, Macpeak & Seas

[57] ABSTRACT

An embroidering machine includes a frame for holding a work piece, a sewing machine for making an embroidery on the work piece, a controller establishing an embroidering operation by moving the frame, under the sewing machine, horizontally and vertically in a common plane based on embroidering data, and establishing calculations, before initiation of the sewing machine operation, of a single time duration required for one single complete movement of the frame based on the embroidering data and a total time duration required for the embroidering operation as a sum of the single time durations, and an indicator for indicating the total time duration.

4 Claims, 4 Drawing Sheets

EMBROIDERING MACHINE

BACKGROUND OF THE INVENTION

The present invention relates to an embroidering machine, and in particular to an automatically operated embroidering machine in which a frame holding a work piece is to be moved relative to a needle of a sewing mechanism in order to establish an embroidery on the work piece.

In general, in a conventional embroidering machine of this type, needle locations are previously designated and therefore the frame is to be moved in a plane according to data in a memory, resulting in a previously determined pattern being made on the work piece. The needle is driven by a motor and an encoder output signal thereof is used as a criteria signal for controlling the position of the frame.

In the foregoing structure, once the setting of the work piece on the frame has been completed, no manual operation is required between an initiation and a termination of operation of the machine. Under such a situation, an operator can be free from watching the machine and can engage in another job. In this case, a digital indication is desirable as to how long he/she is out of engagement with the machine after initiation thereof.

However, in the conventional embroidering machine, though the number of stitches which indicates how often the needle drops into the work piece is known, this number fails to indicate the time required for the needle's transfer from a specific needle location to the next needle location. In addition, the length between two adjacent or successive needle locations is variable. Thus, even though the number of stitches is known, the operation time of the machine or the time duration between the initiation and termination of operation of the machine can not be forecasted precisely, and the operator is compelled to watch the machine whether it is in operation or not even while he/she is engaged in another job, with the result that the operator's productivity is limited.

SUMMARY OF THE INVENTION

It is, therefore, an object of the present invention to provide an embroidering machine without the foregoing drawbacks.

It is another object of the present invention to provide an embroidering machine in which a required operation time thereof is indicated.

In order to attain the foregoing objects, an embroidering machine comprises a frame for holding a work piece, a sewing machine for making an embroidery on the work piece, a controller establishing an embroidering operation by moving the frame, under the sewing machine, horizontally and vertically in a common plane based on embroidering data, and establishing calculations, before an initiation of the sewing machine, of a single time duration required for one single complete movement of the frame based on the embroidering data and a total time duration required for the embroidering operation as a sum of each of the time durations, and an indicator for indicating the total time duration.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENT

A preferred embodiment of the present invention will be described hereinunder in detail with reference to the accompanying drawings.

Figure 1:
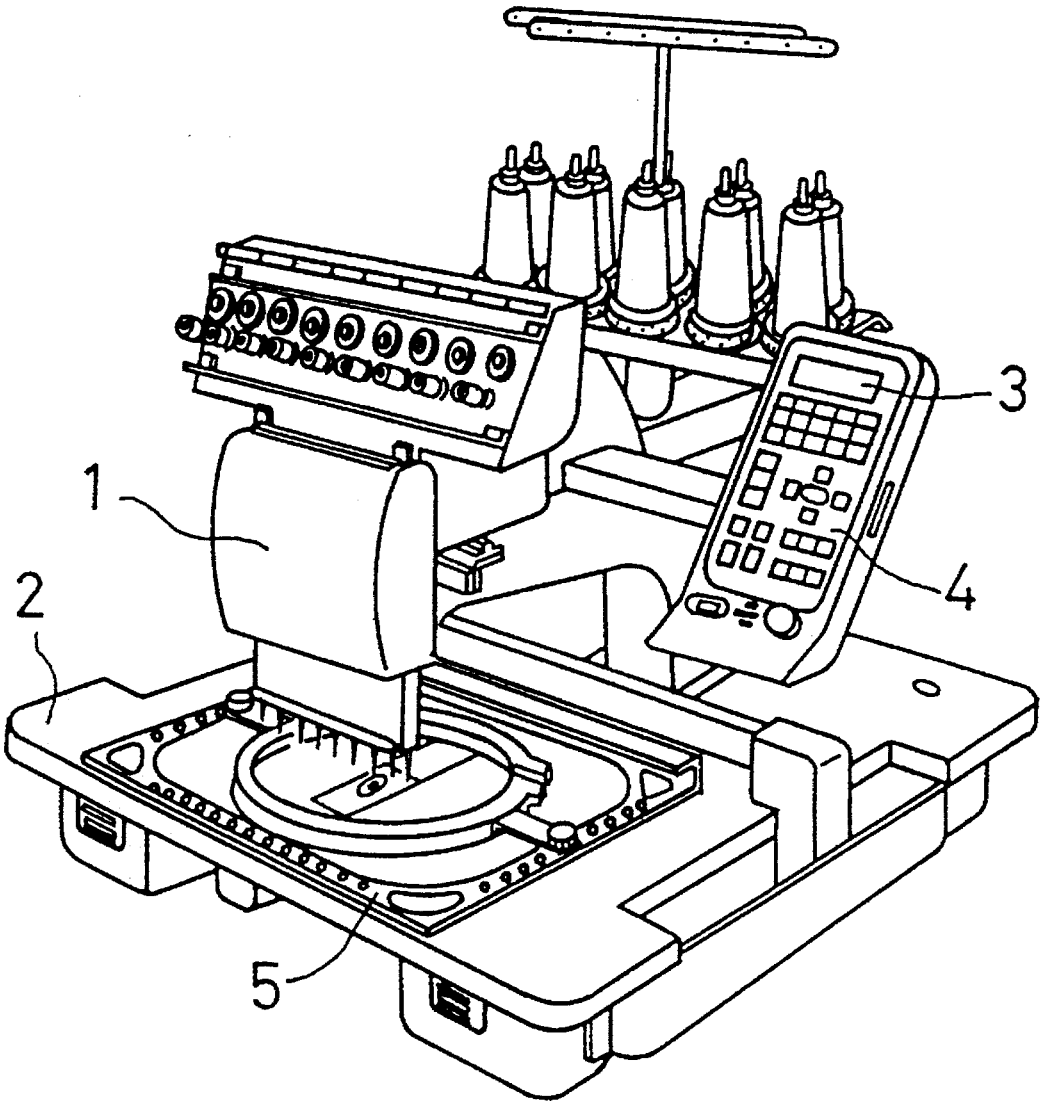
FIG. 1 is a perspective view of an embroidering machine according to an embodiment of the present invention.
Figure 2:
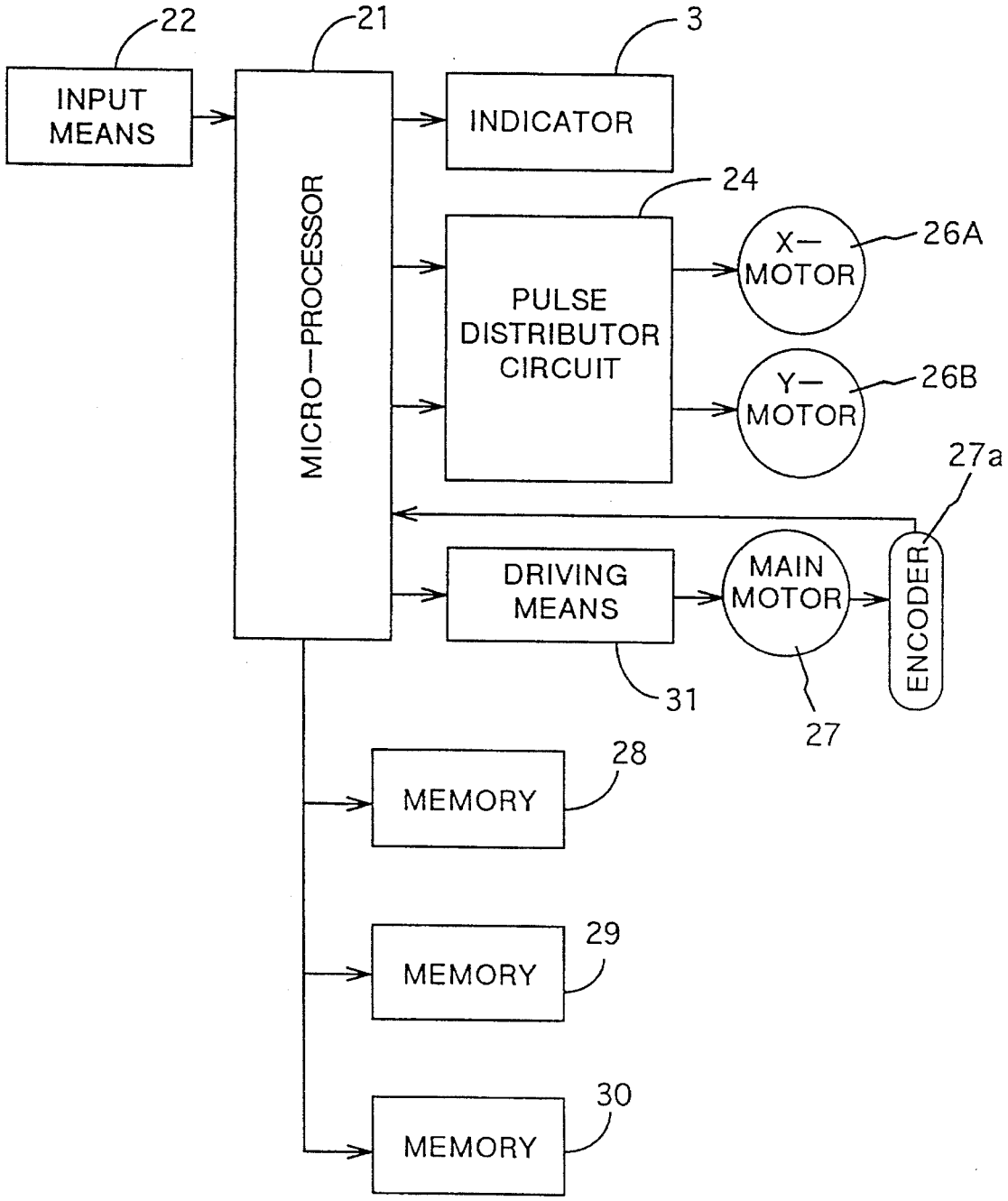
FIG. 2 is a block-diagram of a time duration calculating means as a principal portion of the present invention.
Figure 4:
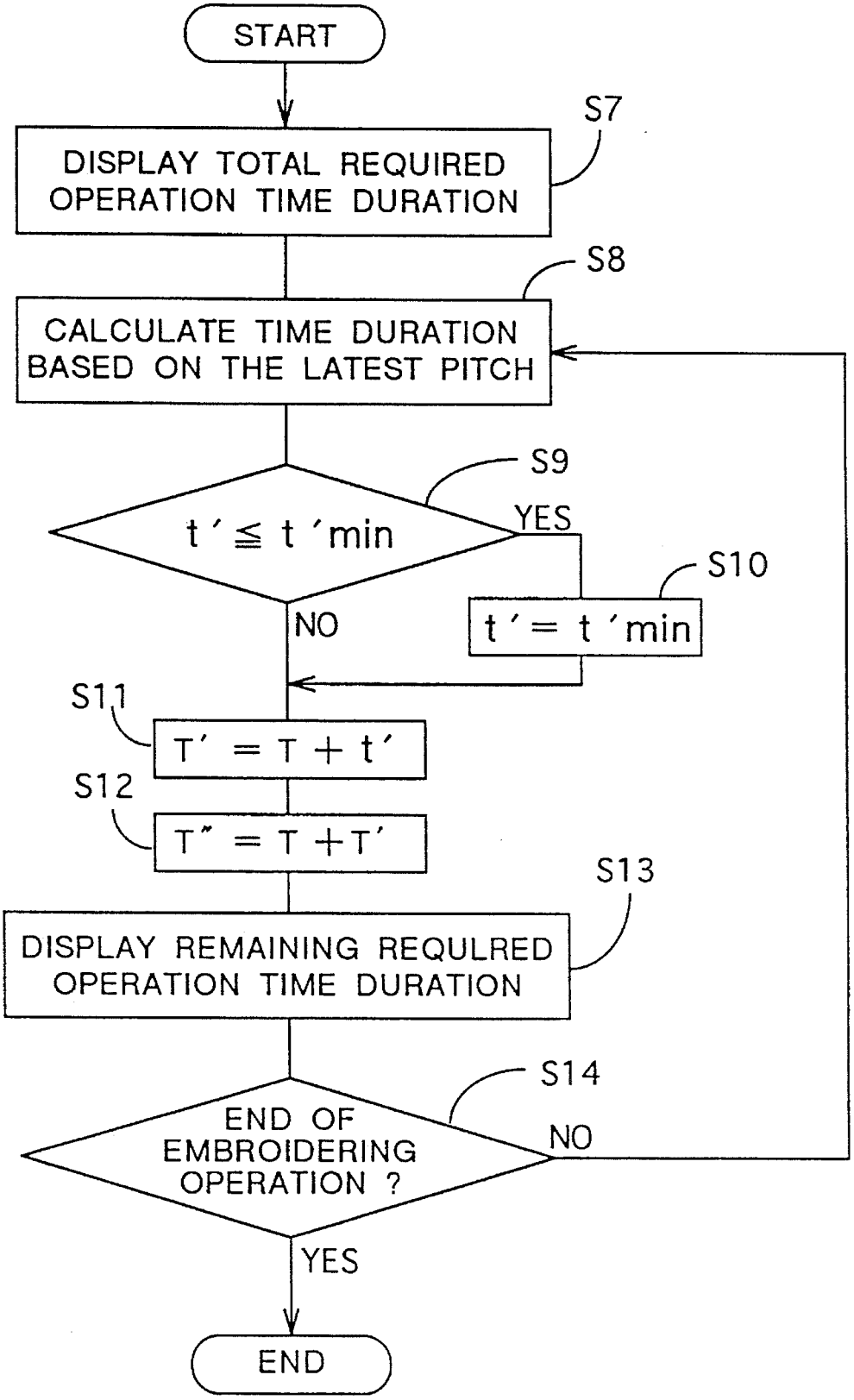
FIG. 4 is a flow-chart showing a calculation of time duration during an embroidering operation.

Referring first to FIGS. 1 and 4, an embroidering machine includes, as seen from FIG. 1, a sewing machine 1, an X-Y table 2 positioned below the sewing machine 1, and a controller 4 having an indicator 3 for indicating an embroidering condition. The X-Y table 2 is provided with a frame 5 which is expected to be moved in a plane by a driving portion having an X-motor 26A and a Y-motor 26(B) (cf. FIG. 2). The moving quantity and direction of the frame 5 depends on embroidering data.

The sewing machine 1 is expected to be driven by a main motor 27 (FIG. 2) which is also called an upper shaft motor. When the embroidering machine is operated after inputting the embroidering data into the controller 4 and mounting a work piece (not shown) on the frame 5, an embroidery with a specific pattern is made on the work piece in accordance with the embroidering data.

In addition to the foregoing features, the embroidering machine according to the present invention has additional features or functions. That is to say, in the micro-processor 21, embroidering data are converted into a time duration, a total or required operation time duration is calculated, and the remaining operation time duration is calculated.

The micro-processor 21 has therein program memories and a working or temporal RAM. The micro-processor 21 is connected with an input means 22, a plurality of memories 28, 29 and 30 each of which stores respective embroidering data, the indicator 3, a driving means 31 for driving the main motor 27, and a pulse distributor circuit 24 for driving the X-motor 26A and the Y-motor 26B.

The input means 22 is expected to bring one of the memories 28, 29 and 30 into an accessible condition upon key-operation. The resultant embroidering data after being read indicates needle locations in the form of plane coordinates for the frame 5. The length ratio between X-direction length and the Y-direction length between two adjacent needle locations determines the pulse distribution ratio between the X-motor 26A and the Y-motor 26B. In addition, the oblique side of the right-angled triangle which is defined by the X-direction length and the Y-direction length defines a pitch between two adjacent needle locations, and the main motor 27 is rotated or turned on depending on the resultant pitch. The main motor 27 is provided with an encoder 27*a* and its pulse output is used as a criteria signal for controlling the the X-motor 26A and the Y-motor 26B after being fed-back to the micro-processor 21.

At this stage, the operator can determine or limit the maximum rotational speed of the main motor 27. This maximum rotational speed of the main motor 27 corresponds to an embroidering speed and determines an embroidering accuracy.

Hereinafter an operation of the foregoing structured embroidering machine will be explained with reference to FIGS. 3 and 4.

Figure 3:
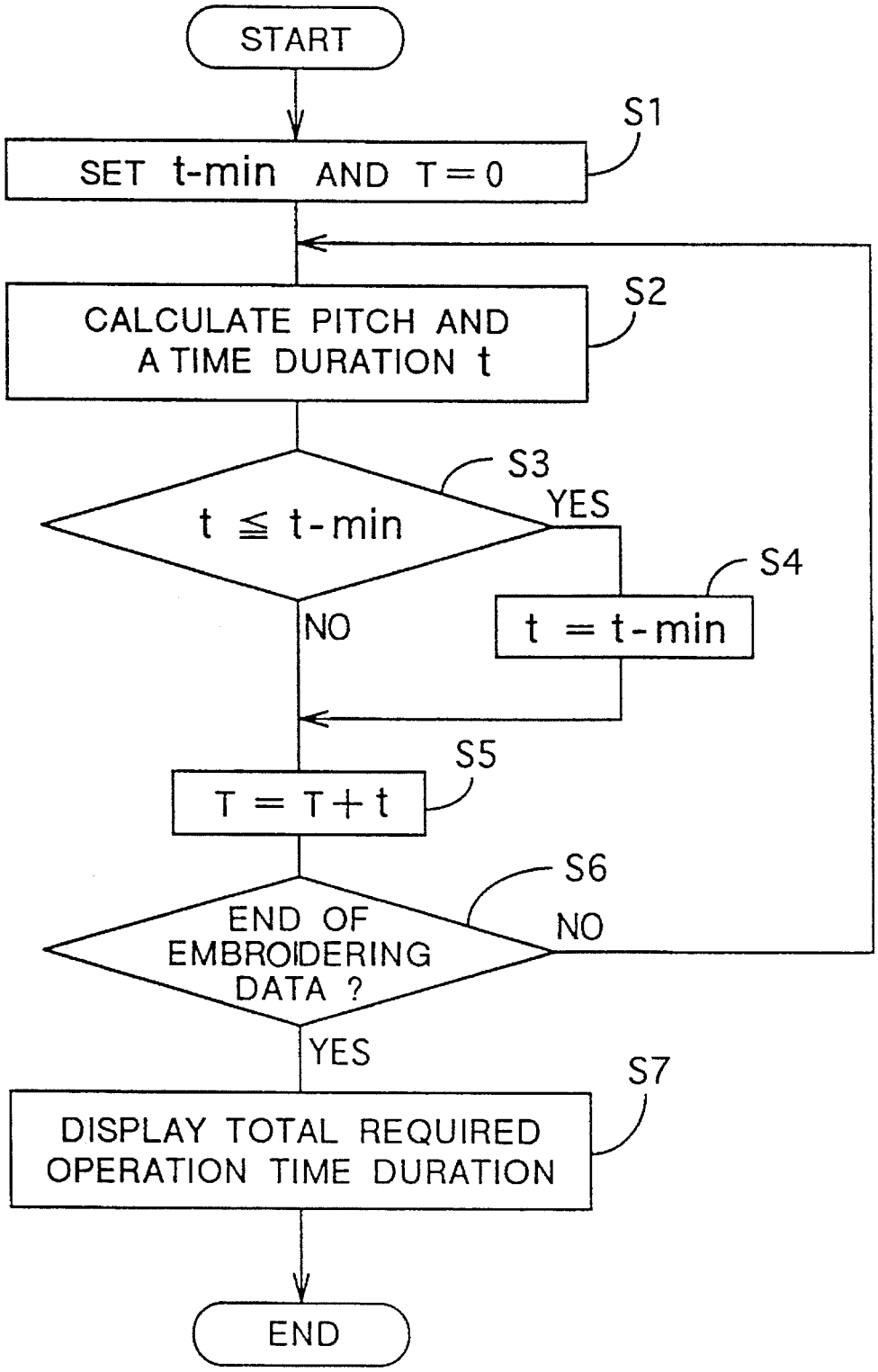
FIG. 3 is a flow-chart showing a calculation of time duration when embroidering data is inputted.

FIG. 3 shows a flow-chart for calculating the required time duration from the initiation to the termination of operation of the embroidering machine when the embroidering data are inputted. Prior to this procedure, the setting of the frame 5 is established. After this setting, in step S1, the micro-processor 21 sets the embroidering speed, a variable T to zero which indicates the required operation time duration of the machine for making a single complete embroidery, and a variable $t_{min}$ to a value which indicates the minimum time duration for moving the frame 5 one complete pitch. The meaning of this value will become apparent later.

In step S2, the pitch between two adjacent needle locations is calculated and a time duration t for moving the frame 5 one complete pitch is calculated by using a rotational speed of the main motor 27 which corresponds to the resultant pitch.

At this stage, the relationship among the pitch, the rotational speed of the main motor 27, and the time duration t is explained. As apparent from the table shown below, in this machine, the rotational number of the main motor 27 is expected to be corresponded to a pitch range.

| pitch | rotational speed | time duration t |
|---|---|---|
| 0~2.4 mm | 1000 rpm | 0.06 sec |
| 2.5~3.9 mm | 700 rpm | 0.085 sec |
| 4.0~6.4 mm | 600 rpm | 0.1 sec |
| 6.5~8.9 mm | 500 rpm | 0.12 sec |
| 8.0~12.7 mm | 450 rpm | 0.133 sec |

In this machine, the maximum rotational speed of the main motor 27 is variable due to the fact that, for example, the main motor 27 is requested to rotate at 800 rpm upon 2.4 mm movement of the frame 5 in order to avoid an unexpected breaking of the thread. Under such a request, instead of 0.06 sec, 0.075 sec is used. This value is stored, in step S1, as the minimum time duration t-min. It is to be noted that the foregoing table is stored in the memory.

If the resultant time duration t in step S3 is judged to be greater than the minimum time duration t-min, such a time duration t is added to the required operation time duration T in step S5. If the result in step S3 is that the resultant time duration t is not greater than the minimum time duration t-min, before performing step S5, step 4 is performed for replacing the resultant time duration t in step S3 with the minimum time duration t-min. In step S6, it is checked whether there is remaining data or not.

A loop operation which is constituted by steps S2, S3, S4, S5 and S6 is set to be executed so long as one or more embroidering data exists. If the result in step S6 is positive, the required operation time duration T is fixed and is indicated on the indicator 3 which is in the form of a liquid-crystal display. After such an indication, the embroidering machine operation is initiated.

Even while the embroidering machine is in operation, an interruption can be executed for indicating the remaining operation time duration which can be obtained by a procedure shown in FIG. 4.

The procedure shown in FIG. 4 is similar to that shown in FIG. 3, and is to obtain the remaining operation time duration such that the current accumulated or required operation time duration is subtracted from the fixed required operation time duration T.

The details of the flow-chart shown in FIG. 4 are as follows. Under a condition that the fixed required operation time duration T is being indicated in step S7, if the embroidering machine operation is initiated, as in step S2, step S8 is performed for calculating a time duration t' per one stitch on the basis of a pitch between the last two adjacent needle locations. The resultant time duration t' is compared to the minimum time duration t'-min in step S9. If t'>t'-min, the control goes to step S11. If t'≦t'-min, step S10 is executed for replacing the time duration t' with the minimum time duration t'-min. Step S11 corresponding to step S5 calculates an accumulated or current total required operation time duration T'. In step S12, the accumulated or current total required operation time duration T' is subtracted from the fixed total required operation time duration T for obtaining a remaining operation time duration T". In step S13, the resultant remaining operation time duration T" is indicated. After such an indication, if there is a subsequent embroidering operation in step S14, the control is returned to step S8.

As detailed above, in the embroidering machine in accordance with the present invention, the total required operation time duration can be displayed, which enables the operator to forecast how long he/she can engage in another job apart from the embroidering machine, and the indication of the remaining time duration enables the operator to know when he/she has to return to the embroidering machine.

It should be apparent to one skilled in the art that the above-described embodiment is merely illustrative of but a few of the many possible specific embodiments of the present invention. Numerous and various other arrangements can be readily devised by those skilled in the art without departing from the spirit and scope of the invention as defined in the following claims.

What is claimed is:

1. An embroidering machine comprising:

a frame for holding a work piece;

a sewing machine for making an embroidery on the work piece;

a controller for controlling an embroidery operation by determining movement of the frame, under the sewing machine, horizontally in two perpendicular directions in a common plane based on embroidering data, and performing calculations, before sewing machine operation is initiated, to determine the length of a single time duration required for one single complete movement of the frame based on the embroidering data and the length of a total time duration required for the embroidering operation corresponding to a sum of a plurality of separately calculated single time durations;

a main motor for driving said sewing machine and driving means for varying a rotational speed of said main motor in accordance with a pitch between two adjacent needle locations; and an indicator for indicating the length of the total time duration.

2. An embroidering machine in accordance with claim 1, wherein the controller calculates the length of a remaining time duration required for the embroidering operation by subtracting the length of a single time duration from the total time duration whenever each movement of the frame occurs, and the indicator displays the length of the resultant total time duration as the remaining time duration.

3. An embroidering machine in accordance with claim 1, wherein the controller is a micro-processor.

4. An embroidering machine in accordance with claim 1, wherein the indicator is a liquid crystal display.

* * * * *